US009756932B2

(12) United States Patent
Mongan et al.

(10) Patent No.: US 9,756,932 B2
(45) **Date of Patent: *Sep. 12, 2017**

(54) TOOTHBRUSH STERILIZATION SYSTEM

(71) Applicants: Ryan Mongan, Orange, CA (US); Simon Ghahary, Long Beach, CA (US)

(72) Inventors: Ryan Mongan, Orange, CA (US); Simon Ghahary, Long Beach, CA (US)

(73) Assignee: TAO CLEAN, LLC, Orange, CA (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/604,729

(22) Filed: Jan. 25, 2015

(65) Prior Publication Data

US 2015/0216294 A1 Aug. 6, 2015

Related U.S. Application Data

(60) Provisional application No. 61/934,500, filed on Jan. 31, 2014.

(51) Int. Cl.
*A46B 17/06* (2006.01)

(52) U.S. Cl.
CPC .... *A46B 17/065* (2013.01); *A46B 2200/1066* (2013.01)

(58) Field of Classification Search
CPC ..... A46B 17/065; A61L 2/10
See application file for complete search history.

(56) References Cited

U.S. PATENT DOCUMENTS 3,820,251 A * 6/1974 Abernathy ..... F26B 9/003 219/386
6,461,568 B1 * 10/2002 Eckhardt ..... A61L 2/10 250/455.11
7,213,603 B2 * 5/2007 Pinsky ..... A61L 2/10 132/310

FOREIGN PATENT DOCUMENTS

CN 201253363 * 6/2009
GB 1195209 * 6/1970

OTHER PUBLICATIONS

English Machine Translation of CN 201253363. Zhouquing. Jun. 2009.*

* cited by examiner

*Primary Examiner* — Donald Spamer
(74) *Attorney, Agent, or Firm* — MaxvalueIP LLC

(57) ABSTRACT

In one example, we describe a method and system for toothbrush sterilization and/or storage with better quality in terms of hygiene and convenience, where the brush head and the shaft that enter the user's mouth are never contacted by the chamber. Also, below the brush head and shaft, there is no chamber. If any drops of water were to fall off the brush head, they would fall all the way through the chamber and reside on the counter on which the chamber rests, which can be removed or cleaned easily later. In one example, we use a UV-C lamp as our sterilization technique. This selection has many advantages over the other sterilizations techniques. In one example, we use a single lamp, but that lamp is in a ring configuration (otherwise known as annular, torus, or donut), with good coverage of the toothbrush, from all angles.

24 Claims, 12 Drawing Sheets

TOOTHBRUSH STERILIZATION SYSTEM

RELATED APPLICATIONS

This application is related and gets the benefit of the priority date and filing date of the prior (provisional) U.S. patent application, titled "Toothbrush Sterilization System", filed Jan. 31, 2014, Ser. No. 61/934,500, with the same assignee. All of the teachings of the provisional case are incorporated herein, by reference.

BACKGROUND OF THE INVENTION

Toothbrushes are proven to be important for the general health and dental health of an individual. Because of the intimacy that the user shares with this particular product, the toothbrush can be a factor which promotes or extends illnesses. Because of their frequent wet nature, the portion of the brush that the user places in his/her mouth may harbor pathogens. Even a brush used exclusively by a healthy individual may have an unhealthy germ build-up over a period of time. Such germs may come from the user's own mouth and/or from the environment in which the toothbrush is kept between uses.

Most toothbrushes are kept in bathrooms, which are often fertile environments for germs. In addition to being wet, it is difficult to remove all traces of food particles from a brush after usage. These organic particles may serve as a culture for the promotion of molds and bacteria. In addition to between usage cleanliness, there is a need to ensure brushes are clean prior to their initial use. Regulations do not currently exist to require a particular level of sterilization or sanitation of toothbrushes prior to packaging and sale.

Accordingly, there is a great need for a device that effectively sanitizes toothbrushes before and between uses by consumers. And, in fact, inventions that attempt to achieve this have been known in the literature for over a century. The vast majority of these inventions involve a toothbrush and chamber. The user returns the brush to the chamber between uses. Within the chamber resides a sterilization means. Over the years, the exact nature of this sterilization means has changed—sometimes due to technology advancements, while other times due to efficacy, safety, manufacturing cost, or convenience.

TABLE 1

The table below lists several inventions that are typical of various sterilization means.

| Patent No. or SN | Issue Date or Publication Date | Inventor | Sterilization Means |
|---|---|---|---|
| 615,357 | 6 Dec. 1898 | Guilfoyle | Gas blanket |
| 757,885 | 3 Aug. 1903 | Cochkane | Liquid immersion |
| 2,579,242 | 18 Dec. 1951 | Pask | Ultraviolet lamp |
| 3,342,544 | 18 Sep. 1963 | Raymond | Aerosol or liquid spray |
| 3,884,635 | 20 May 1975 | Sloan | Dryer |
| 4,400,357 | 23 Aug. 1983 | Hoffman | Autoclave |
| 5,725,091 | 9 Mar. 1994 | Knoebel | Vacuum |

One undesirable aspect of some of the prior art is that they necessitate the bristles of the brush, or a portion of the brush in close proximity to the bristles which re-enters the user's mouth and touches on some part of the sterilization chamber, on insertion, extraction, or during the sterilization process. This undesirable contact could transfer pathogens or debris from the chamber back onto the brush and vice/versa. This causes a cross-contamination, going back-and-forth, with some residual pathogens or debris always remaining in the system. An example of this type of invention can be seen in Athon, U.S. Pat. No. 1,696,706. This invention relies on the bristles to be in frictional contact with the inside of the chamber, in order to keep the brush from falling out. Similarly, Farrar U.S. Pat. No. 2,592,131 creates a lip on which the bristles rest. The following inventions all suffer from this undesirable contact.

TABLE 2

The prior art with similar problems (as mentioned above).

| Pat # or SN | Issue or Publ. Date | Inventor |
|---|---|---|
| 615,357 | 6 Dec. 1898 | Guilfoyle |
| 1,070,858 | 19 Aug. 1913 | Trayne |
| 1,262,465 | 9 Apr. 1918 | Dohrmann |
| 1,283,403 | 29 Oct. 1918 | Eustis |
| 1,486,957 | 18 Mar. 1924 | England |
| 1,696,706 | 25 Dec. 1928 | Athon |
| 1,743,646 | 13 Jan. 1926 | Alderman |
| 2,099,336 | 16 Nov. 1937 | Hart |
| 2,180,213 | 13 Nov. 1935 | Willis |
| 2,280,431 | 20 Apr. 1938 | Hart |
| 2,457,500 | 28 Dec. 1948 | Seandura |
| 2,554,156 | 22 May 1951 | Rosenthal |
| 2,592,131 | 8 Apr. 1952 | Farrar |
| 2,817,104 | 24 Dec. 1957 | Hartzell |
| 3,100,842 | 13 Aug. 1963 | Tellefsen |
| 3,114,038 | 10 Dec. 1963 | Meader |
| 3,342,544 | 18 Sep. 1963 | Raymond |
| 3,309,159 | 14 Mar. 1967 | Le Sueur |
| 3,353,905 | 21 Nov. 1967 | Douglas |
| 3,574,879 | 13 Apr. 1971 | Werding |
| 3,741,378 | 26 Jun. 1973 | Parker |
| 3,748,094 | 23 Jul. 1969 | Scheidell |
| 3,955,922 | 11 May 1976 | Moulthrop |
| 4,088,445 | 9 May 1978 | Ellis |
| 4,473,152 | 25 Sep. 1984 | Jump |
| 4,585,119 | 28 Apr. 1982 | Boyinton |
| 4,816,648 | 28 Mar. 1989 | Dusbabek |
| 4,915,219 | 9 Apr. 1986 | Ottimo |
| 4,995,509 | 26 Feb. 1991 | Kornfeind |
| 5,126,572 | 30 Jun. 1992 | Chu |
| 5,690,214 | 24 Nov. 1993 | Gaines |
| 5,922,292 | 13 Jul. 1999 | Duczek |
| 5,960,801 | 5 Oct. 1999 | Vermooten |
| 6,565,819 | 19 May 1999 | Herrera |
| 6,728,990 | 4 May 2004 | Jones |
| 7,063,822 | 20 Jun. 2006 | Goertz |
| 7,213,603 | 8 May 2007 | Pinsky |
| 7,511,283 | 31 Mar. 2009 | Chor |
| 7,581,638 | 31 Aug. 2005 | Shaw |
| 7,838,846 | 22 Nov. 2006 | Pinsky |
| 2004/0155201 A1 | 12 Aug. 2004 | Russell |
| 2005/0276736 A1 | 15 Dec. 2005 | Miller |
| 2006/0011209 A1 | 19 Jan. 2006 | Mehes |
| 2006/0204416 A1 | 14 Sep. 2006 | Hayes |
| 2007/0295916 A1 | 27 Dec. 2007 | Reuben |
| DE 19606136 A1 | 21 Aug. 1997 | Fritz |

Many of the prior art inventions necessitate the user to perform additional actions to put the brush into the chamber, remove it, or activate the sterilization cycle. For example, Fowler U.S. Pat. No. 1,074,169 teaches an enclosure that fully encloses the brush. In order to insert the brush or to remove it, the user needs to open a door to gain access. This can be inconvenient if the user is already holding a container of dentifrice in one hand. Thompson U.S. Pat. No. 1,553,648 is a typical of a class of solutions where the brush can be accessed without opening a door. In these solutions the seal between the chamber and the brush assembly is accomplished by the use of a compliant stopper or a compliant chamber. The user then needs to either hold onto the chamber to keep it steady while extracting the brush or the chamber needs to be mounted to a fixed surface, e.g., a wall. Mounting is an additional action that can be inconvenient or impractical in many environments. MacShane U.S. Pat. No. 1,708,423 requires the user to perform a separate action in order to start the sterilization process.

TABLE 3

The following inventions all suffer from the effect that the user needs to perform an additional action in order to load the brush into the chamber, remove it, or start the sterilization process.

| Patent # or SN | Issue or Publ. Date | INVENTOR |
|---|---|---|
| 757,885 | 3 Aug. 1903 | Cochkane |
| 827,308 | 31 Jul. 1906 | Hitch |
| 880,432 | 25 Feb. 1908 | Weidhaas |
| 1,051,433 | 28 Jan. 1913 | Moseley |
| 1,062,961 | 27 May 1913 | Funcke |
| 1,074,169 | 30 Sep. 1913 | Fowler |
| 1,122,881 | 29 Dec. 1914 | Dye |
| 1,212,335 | 16 Jan. 1917 | Fineberg |
| 1,278,789 | 10 Sep. 1918 | Thompson |
| 1,283,403 | 29 Oct. 1918 | Eustis |
| 1,303,884 | 20 May 1919 | Goodnow |
| 1,336,345 | 6 Apr. 1920 | Lackey |
| 1,364,557 | 4 Jan. 1921 | Hurley |
| 1,448,231 | 13 Mar. 1923 | Morrison |
| 1,451,425 | 10 Apr. 1923 | Hurley |
| 1,507,466 | 2 Sep. 1924 | Collins |
| 1,553,648 | 15 Sep. 1925 | Thompson |
| 1,562,348 | 17 Nov. 1925 | Lockery |
| 1,625,202 | 19 Apr. 1927 | Gindick |
| 1,708,423 | 9 Apr. 1929 | MacShane |
| 1,811,732 | 23 Jun. 1931 | Pfeifer |
| 1,981,383 | 8 Jan. 1935 | Feldon |
| 1,987,472 | 8 Jan. 1935 | Feldon |
| 2,099,336 | 16 Nov. 1937 | Hart |
| 2,180,213 | 14 Nov. 1939 | Peake |
| 2,195,935 | 2 Apr. 1940 | Nuyts |
| 2,280,431 | 21 Apr. 1942 | Hart |
| 2,424,036 | 15 Jul. 1947 | Jackel |
| 2,457,500 | 28 Dec. 1948 | Seandura |
| 2,554,156 | 22 May 1951 | Rosenthal |
| 2,579,242 | 18 Dec. 1951 | Pask |
| 2,584,042 | 29 Jan. 1952 | Ober |
| 2,587,131 | 26 Feb. 1952 | Ficken |
| 2,592,131 | 8 Apr. 1952 | Farrar |
| 2,817,104 | 24 Dec. 1957 | Hartzell |
| 2,822,476 | 4 Feb. 1958 | Osgood |
| 3,114,038 | 10 Dec. 1963 | Meader |
| 3,207,296 | 21 Sep. 1965 | Goodall |
| 3,309,159 | 14 Mar. 1967 | Le Sueur |
| 3,342,544 | 19 Sep. 1967 | Curiel |
| 3,683,638 | 15 Aug. 1972 | Devon |
| 3,748,094 | 24 Jul. 1973 | Scheidell |
| 3,820,251 | 28 Jun. 1974 | Abernathy |
| 3,881,868 | 6 May 1975 | Duke |
| 3,884,635 | 20 May 1975 | Sloan |
| 3,904,362 | 9 Sep. 1975 | Dipaolo |
| 3,954,407 | 4 May 1976 | Andary |
| 3,955,922 | 11 May 1976 | Moulthrop |
| 4,214,657 | 29 Jul. 1980 | Winston |
| 4,400,357 | 23 Aug. 1983 | Hoffman |
| 4,552,728 | 12 Nov. 1985 | Taylor |
| 4,570,652 | 18 Feb. 1986 | Chavez |
| 4,625,119 | 25 Nov. 1986 | Murdock |
| 4,740,706 | 26 Apr. 1988 | Murdock |
| 4,759,383 | 26 Jul. 1988 | Phillips |
| 4,803,364 | 7 Feb. 1989 | Ritter |
| 4,806,770 | 21 Feb. 1989 | Hylton |
| 4,816,648 | 28 Mar. 1989 | Dusbabek |
| 4,845,859 | 11 Jul. 1989 | Evans |
| 4,884,688 | 5 Dec. 1989 | Hurst |
| 4,888,487 | 19 Dec. 1989 | Ritter |
| 4,906,851 | 6 Mar. 1990 | Beasley |
| 4,950,902 | 21 Aug. 1990 | Ritter |
| 4,973,847 | 27 Nov. 1990 | Lackey |

TABLE 3-continued

The following inventions all suffer from the effect that the user needs to perform an additional action in order to load the brush into the chamber, remove it, or start the sterilization process.

| Patent # or SN | Issue or Publ. Date | INVENTOR |
|---|---|---|
| 4,997,629 | 5 Mar. 1991 | Marchand |
| 5,023,460 | 11 Jun. 1991 | Foster |
| 5,086,916 | 11 Feb. 1992 | Gray |
| 5,107,987 | 28 Apr. 1992 | Palazzolo |
| 5,127,521 | 7 Jul. 1992 | Bourque |
| 5,295,575 | 22 Mar. 1994 | Gonzalez |
| 5,377,824 | 3 Jan. 1995 | Seymour |
| 5,402,810 | 4 Apr. 1995 | Donley |
| 5,405,587 | 11 Apr. 1995 | Fernandez |
| 5,487,877 | 30 Jan. 1996 | Choi |
| 5,566,823 | 22 Oct. 1996 | Summers |
| 5,620,622 | 15 Apr. 1997 | Lang |
| 5,692,603 | 2 Dec. 1997 | Stotesbury |
| 5,725,091 | 10 Mar. 1998 | Knoebel |
| 5,772,015 | 30 Jun. 1998 | Musiel |
| 5,852,879 | 29 Dec. 1998 | Schumaier |
| 5,882,613 | 16 Mar. 1999 | Gipson |
| 5,919,416 | 6 Jul. 1999 | Auger |
| 5,922,292 | 13 Jul. 1999 | Duczek |
| 5,960,801 | 5 Oct. 1999 | Vermooten |
| 6,099,813 | 8 Aug. 2000 | Gipson |
| 6,119,854 | 19 Sep. 2000 | Prentice |
| 6,135,279 | 24 Oct. 2000 | Dryer |
| 6,213,777 | 10 Apr. 2001 | Seitzinger |
| 6,253,773 | 3 Jul. 2001 | Ingemann |
| 6,360,884 | 26 Mar. 2002 | Smith |
| 6,558,640 | 6 May 2003 | Nottingham |
| 6,601,699 | 5 Aug. 2003 | Naredo |
| 6,702,113 | 9 Mar. 2004 | Marino |
| 6,753,537 | 22 Jun. 2004 | Woo |
| 6,874,247 | 5 Apr. 2005 | Hsu |
| 6,966,441 | 22 Nov. 2005 | Barham |
| 6,967,337 | 22 Nov. 2005 | Fonowich |
| 7,063,822 | 20 Jun. 2006 | Goertz |
| 7,213,603 | 8 May 2007 | Pinsky |
| 7,951,343 | 31 May 2011 | Davis |
| 8,399,853 | 29 Mar. 2013 | Roiniotis |
| 2002/0031461 A1 | 14 Mar. 2002 | Knipp |
| 2002/0121449 A1 | 5 Sep. 2002 | Bowie |
| 2004/0129580 | 8 Jul. 2004 | Cochran |
| 2004/0134800 A1 | 15 Jul. 2004 | Pigeon |
| 2004/0155201 | 12 Aug. 2004 | Russell |
| 2004/0155201 A1 | 12 Aug. 2004 | Russell |
| 2004/0159330 A1 | 19 Aug. 2004 | Anemone |
| 20050274906 A1 | 15 Dec. 2005 | Riddell |
| 2006/0204416 A1 | 14 Sep. 2006 | Hayes |
| 20080219883 A1 | 11 Sep. 2008 | Thur |
| 20090322190 A1 | 31 Dec. 2009 | Kitagawa |
| US20120138491 | 7 Jun. 2012 | Goss |
| JP H09-225012, A | 2 Sep. 1997 | KYOJI |
| JP H11-318566, A | 24 Nov. 1999 | KASAI KUNIO |
| CN 202801404 U | 20 Mar. 2013 | Zhang |
| EP0925794 A2 | 30 Jun. 1999 | Beghelli |

Hecker U.S. Pat. No. 6,123,477 teaches a sterilizer that does not include a chamber. In this invention, a second brush is used to wipe down the bristles of the toothbrush. This has the obvious shortcoming that the toothbrush is exposed to the ambient environment between sterilizations instead of being protected in a chamber. In addition, the efficacy seems highly dependent on user technique. It also is only focused on sterilization of the bristles as opposed to conditioning of all the surfaces that will enter the user's mouth.

TABLE 4

The table below lists inventions that teach self-contained toothbrush sterilization and have the shortcomings described above.

| Patent No. or SN | Issue/Publ. Date | INVENTOR |
|---|---|---|
| 2,527,741 | 31 Oct. 1950 | Lamonde |
| 5,832,940 | 10 Nov. 1998 | Embry |
| 6,123,477 | 26 Sep. 2000 | Hecker |
| 6,669,390 | 30 Dec. 2003 | Porter |
| 8,168,963 | 1 May 2012 | Ratcliffe |

Lamonde, Embry, and Porter do not teach sterilization. These inventions deliver dentifrice or mouthwash. However, a sterilization fluid could be envisioned as a substitute for the dentifrice.

In all of the prior inventions that include a sterilization chamber, there is either contact between elements of the toothbrush that the user puts into his or her mouth (mentioned previously), or there exists portions of the chamber immediately below the bristles and toothbrush shaft that enter the mouth. The disadvantage with this is that fluid or particles that fall off the brush end up inside the chamber. Since the brush is put into the chamber immediately after usage, it goes in loaded with a certain amount of water. A drop of two of this water can fall off the brush, bringing along with it food particles, dentifrice, or even pathogens that have come from the user's mouth or the environment around the brush.

Some of the inventions allow for the presence of a dryer in order to drive water from the chamber (e.g. Choi U.S. Pat. No. 5,487,877). Even if the water is driven from the chamber, the particles contained within the water will remain behind. At best, this will lead to a buildup of particulates in the chamber requiring frequent cleanings. At worst, it may become a breeding ground for germs exposing the brush to a more adverse environment than if it had never entered the chamber. Many of the prior inventions rely on a completely closed chamber to ensure the sterilization means does not leak into the surrounding environment (e.g., Hurley U.S. Pat. No. 1,364,557, Eckhardt U.S. Pat. No. 6,461,568, and Barham U.S. Pat. No. 6,966,441).

Thus, in summary, the prior art (shown below) are design patents, or are not toothbrush sterilizers, or have some disadvantages with respect to our invention described here in this disclosure.

TABLE 5

List of the related prior art, which, e.g., do not have the advantages of our invention (described here in this disclosure).

| Patent No. or SN | Issue/Public. Date | INVENTOR |
|---|---|---|
| 615,357 | 6 Dec. 1898 | Guilfoyle |
| 757,885 | 3 Aug. 1903 | Cochkane |
| 827,308 | 31 Jul. 1906 | Hitch |
| 880,432 | 25 Feb. 1908 | Weidhaas |
| 942,058 | 27 Feb. 1909 | DeGowin |
| 1,050,864 | 21 Jan. 1913 | Smith |
| 1,051,433 | 28 Jan. 1913 | Moseley |
| 1,062,961 | 27 May 1913 | Funcke |
| 1,070,858 | 19 Aug. 1913 | Trayne |
| 1,074,169 | 30 Sep. 1913 | Fowler |
| 1,079,618 | 25 Nov. 1913 | Trayne |
| 1,122,881 | 29 Dec. 1914 | Dye |
| 1,137,651 | 27 Apr. 1915 | Metivier |
| 1,212,335 | 16 Jan. 1917 | Fineberg |
| 1,262,465 | 9 Apr. 1918 | Dohrmann |
| 1,278,789 | 10 Sep. 1918 | Thompson |
| 1,283,403 | 29 Oct. 1918 | Eustis |

TABLE 5-continued

List of the related prior art, which, e.g., do not have the advantages of our invention (described here in this disclosure).

| Patent No. or SN | Issue/Public. Date | INVENTOR |
|---|---|---|
| 1,303,884 | 20 May 1919 | Goodnow |
| 1,336,345 | 6 Apr. 1920 | Lackey |
| 1,364,557 | 4 Jan. 1921 | Hurley |
| 1,424,434 | 1 Aug. 1922 | Ausubel |
| 1,448,231 | 13 Mar. 1923 | Morrison |
| 1,451,425 | 10 Apr. 1923 | Hurley |
| 1,480,814 | 15 Jan. 1924 | Bright |
| 1,486,957 | 18 Mar. 1924 | England |
| 1,507,466 | 2 Sep. 1924 | Collins |
| 1,553,648 | 15 Sep. 1925 | Thompson |
| 1,562,348 | 17 Nov. 1925 | Lockery |
| 1,584,261 | 11 May 1926 | Vuolo |
| 1,588,781 | 15 Jun. 1926 | Stoddard |
| 1,625,202 | 19 Apr. 1927 | Gindick |
| 1,696,706 | 25 Dec. 1928 | Athon |
| 1,708,423 | 9 Apr. 1929 | MacShane |
| 1,713,379 | 14 May 1929 | Fromwiller |
| 1,743,646 | 13 Jan. 1926 | Alderman |
| 1,811,732 | 23 Jun. 1931 | Pfeifer |
| 1,981,383 | 8 Jan. 1935 | Feldon |
| 1,987,472 | 8 Jan. 1935 | Feldon |
| 2,046,606 | 7 Jul. 1936 | Borba |
| 2,099,336 | 16 Nov. 1937 | Hart |
| 2,180,213 | 14 Nov. 1939 | Frederick Willis |
| 2,195,935 | 2 Apr. 1940 | Hippolyte |
| 2,280,431 | 21 Apr. 1942 | Hart |
| 2,424,036 | Jul. 15, 1947 | Victor |
| 2,448,603 | Sep. 7, 1948 | Thomas D. Kevin |
| 2,457,500 | Dec. 28, 1948 | Seandura |
| 2,527,741 | Oct. 31, 1950 | Lamonde |
| 2,554,156 | May 22, 1951 | Rosenthal |
| 2,579,242 | Dec. 18, 1951 | Pask |
| 2,584,042 | 29 Jan. 1952 | Ober |
| 2,587,131 | Feb. 26, 1952 | Ficken |
| 2,592,131 | 8 Apr. 1952 | Farrar |
| 2,608,294 | 26 Aug. 1952 | Ward |
| 2,817,104 | 24 Dec. 1957 | Hartzell |
| 2,822,476 | 4 Feb. 1958 | Osgood |
| 3,100,842 | 13 Aug. 1963 | Tellefsen |
| 3,114,038 | 10 Dec. 1963 | Meader |
| 3,207,296 | 21 Sep. 1965 | Goodall |
| 3,321,796 | 30 May 1967 | Lelicoff |
| 3,309,159 | 14 Mar. 1967 | Le Sueur |
| 3,342,544 | 19 Sep. 1967 | Curiel |
| 3,353,905 | 21 Nov. 1967 | Douglas |
| 3,371,260 | 27 Feb. 1968 | Jackson |
| 3,538,616 | 10 Nov. 1970 | Mailing |
| 3,574,879 | 13 Apr. 1971 | Werding |
| 3,683,638 | 15 Aug. 1972 | Devon |
| 3,727,748 | 17 Apr. 1973 | Brown |
| 3,741,378 | Jun. 26, 1973 | Parker |
| 3,746,162 | Jul. 17, 1973 | Bridges |
| 3,748,094 | 24 Jul. 1973 | Scheidell |
| 3,820,251 | Jun. 28, 1974 | Abernathy |
| 3,881,868 | May 6, 1975 | Duke |
| 3,884,635 | May 20, 1975 | Sloan |
| 3,904,362 | Sep. 9, 1975 | Dipaolo |
| 3,954,407 | May 4, 1976 | Andary |
| 3,955,922 | May 11, 1976 | Moulthrop |
| 4,021,197 | May 3, 1977 | Brooks |
| 4,088,445 | May 9, 1978 | Ellis |
| 4,121,107 | Oct. 17, 1978 | Bachmann |
| 4,121,600 | Oct. 24, 1978 | Riddick |
| 4,135,269 | Jan. 23, 1979 | Laurel L. Marston |
| 4,214,657 | 29 Jul. 1980 | Winston |
| 4,219,035 | 26 Aug. 1980 | Deconinck |
| 4,400,357 | 23 Aug. 1983 | Hoffman |
| 4,473,152 | 25 Sep. 1984 | Jump |
| 4,552,728 | 12 Nov. 1985 | Taylor |
| 4,570,652 | 18 Feb. 1986 | Chavez |
| 4,585,119 | 29 Apr. 1986 | Boyington |
| 4,625,119 | 25 Nov. 1986 | Murdock |
| 4,740,706 | 26 Apr. 1988 | Murdock |
| 4,756,412 | 12 Jul. 1988 | Graves |
| 4,759,383 | 26 Jul. 1988 | Phillips |

TABLE 5-continued

List of the related prior art, which, e.g., do not have the advantages of our invention (described here in this disclosure).

| Patent No. or SN | Issue/Public. Date | INVENTOR |
|---|---|---|
| 4,803,364 | 7 Feb. 1989 | Ritter |
| 4,806,770 | 21 Feb. 1989 | Hylton |
| 4,816,648 | 28 Mar. 1989 | Dusbabek |
| 4,817,826 | 4 Apr. 1989 | Judge |
| 4,845,859 | 11 Jul. 1989 | Evans |
| 4,884,688 | 5 Dec. 1989 | Hurst |
| 4,888,487 | 19 Dec. 1989 | Ritter |
| 4,906,851 | 6 Mar. 1990 | Beasley |
| 4,915,219 | 10 Apr. 1990 | Ottimo |
| 4,950,902 | 21 Aug. 1990 | Ritter |
| 4,973,847 | 27 Nov. 1990 | Lackey |
| 4,978,003 | 18 Dec. 1990 | Foster |
| 4,995,509 | 26 Feb. 1991 | Kornfeind |
| 4,995,511 | 26 Feb. 1991 | Evans |
| 4,997,629 | 5 Mar. 1991 | Marchand |
| 5,017,790 | 21 May 1991 | Kojima |
| 5,023,460 | 11 Jun. 1991 | Foster |
| 5,086,916 | 11 Feb. 1992 | Gray |
| 5,107,987 | 28 Apr. 1992 | Palazzolo |
| 5,126,572 | 30 Jun. 1992 | Chu |
| 5,127,521 | 7 Jul. 1992 | Bourque |
| 5,139,142 | 18 Aug. 1992 | Simon |
| 5,145,095 | 8 Sep. 1992 | Loudon |
| 5,215,193 | 1 Jun. 1993 | Dennis |
| 5,295,575 | 22 Mar. 1994 | Gonzalez |
| 5,333,742 | 2 Aug. 1994 | Piedmont |
| 5,377,824 | 3 Jan. 1995 | Seymour |
| 5,402,810 | 4 Apr. 1995 | Donley |
| 5,405,587 | 11 Apr. 1995 | Fernandez |
| 5,409,841 | 25 Apr. 1995 | Chow |
| 5,487,877 | 30 Jan. 1996 | Choi |
| 5,502,900 | 2 Apr. 1996 | Hui |
| 5,522,497 | 4 Jun. 1996 | Stacy |
| 5,566,823 | 22 Oct. 1996 | Summers |
| 5,611,206 | 18 Mar. 1997 | Sargent |
| 5,620,622 | 15 Apr. 1997 | Lang |
| 5,630,505 | 20 May 1997 | Garcia |
| 5,660,285 | 26 Aug. 1997 | Tooma |
| 5,662,130 | 2 Sep. 1997 | Wiltshire |
| 5,690,214 | 25 Nov. 1997 | Gaines |
| 5,692,603 | 2 Dec. 1997 | Stotesbury |
| 5,701,921 | 30 Dec. 1997 | Father |
| 5,725,091 | 10 Mar. 1998 | Knoebel |
| 5,772,015 | 30 Jun. 1998 | Musiel |
| 5,832,940 | 10 Nov. 1998 | Embry |
| 5,852,879 | 29 Dec. 1998 | Schumaier |
| 5,865,195 | 2 Feb. 1999 | Carter |
| 5,881,876 | 16 Mar. 1999 | Nonomura |
| 5,882,613 | 16 Mar. 1999 | Gipson |
| 5,919,416 | 6 Jul. 1999 | Auger |
| 5,922,292 | 13 Jul. 1999 | Duczek |
| 5,960,801 | 5 Oct. 1999 | Vermooten |
| 6,099,813 | 8 Aug. 2000 | Gipson |
| 6,119,854 | 19 Sep. 2000 | Prentice |
| 6,123,477 | 26 Sep. 2000 | Hecker |
| 6,135,279 | 24 Oct. 2000 | Dryer |
| 6,142,318 | 7 Nov. 2000 | Tooma |
| 6,186,324 | 13 Feb. 2001 | Catterson |
| 6,213,777 | 10 Apr. 2001 | Seitzinger |
| 6,253,773 | 3 Jul. 2001 | Ingemann |
| 6,360,884 | 26 Mar. 2002 | Smith |
| 6,488,942 | 3 Dec. 2002 | Ingemann |
| 6,461,568 | 8 Oct. 2002 | Eckhardt |
| 6,558,640 | 6 May 2003 | Nottingham |
| 6,565,819 | 20 May 2003 | Herrera |
| 6,601,699 | 5 Aug. 2003 | Naredo |
| 6,669,390 | 30 Dec. 2003 | Porter |
| 6,702,113 | 9 Mar. 2004 | Marino |
| 6,722,498 | 20 Apr. 2004 | Westfield |
| 6,728,990 | 4 May 2004 | Jones |
| 6,769,828 | 3 Aug. 2004 | Clark |
| 6,753,537 | 22 Jun. 2004 | Woo |
| 6,782,999 | 31 Aug. 2004 | McCoy |
| 6,861,047 | 1 Mar. 2005 | Carnell |
| 6,874,247 | 5 Apr. 2005 | Hsu |

TABLE 5-continued

List of the related prior art, which, e.g., do not have the advantages of our invention (described here in this disclosure).

| Patent No. or SN | Issue/Public. Date | INVENTOR |
|---|---|---|
| 6,935,515 | 30 Aug. 2005 | Sookoo |
| 6,966,441 | 22 Nov. 2005 | Barham |
| 6,967,337 | 22 Nov. 2005 | Fonowich |
| 7,063,822 | 20 Jun. 2006 | Goertz |
| 7,204,957 | 17 Apr. 2007 | Tozer |
| 7,213,603 | 8 May 2007 | Pinsky |
| 7,452,714 | 18 Nov. 2008 | Eversdijk |
| 7,484,629 | 3 Feb. 2009 | Cottrell |
| 7,511,283 | 31 Mar. 2009 | Chor |
| 7,547,893 | 16 Jun. 2009 | Tantillo |
| 7,581,638 | 1 Sep. 2009 | Shaw |
| 7,838,846 | 23 Nov. 2010 | Pinsky |
| 7,856,738 | 28 Dec. 2010 | Camacho |
| 7,888,656 | 15 Feb. 2011 | Freedgood |
| 7,951,343 | 31 May 2011 | Davis |
| 8,168,963 | 1 May 2012 | Ratcliffe |
| 8,235,619 | 7 Aug. 2012 | Meredith |
| 8,399,853 | Mar. 29, 2013 | Roiniotis |
| 2002/0031461 A1 | Mar. 14, 2002 | Knipp |
| 2002/0121449 A1 | Sep. 5, 2002 | Bowie |
| 2004/0129580 | Jul. 8, 2004 | Cochran |
| 2004/0134800 A1 | Jul. 15, 2004 | Pigeon |
| 2004/0155201 | Aug. 12, 2004 | Russell |
| 2004/0155201 A1 | 12 Aug. 2004 | Russell |
| 2004/0159330 A1 | Aug. 19, 2004 | Anemone |
| 20050274906 A1 | 15 Dec. 2005 | Riddell |
| 2005/0276736 A1 | 15 Dec. 2005 | Miller |
| 2006/0011209 A1 | 19 Jan. 2006 | Mehes |
| 2006/0204416 A1 | 14 Sep. 2006 | Hayes |
| 2007/0056864 A1 | 15 Mar. 2007 | Cottrell |
| 20070295916 A1 | 27 Dec. 2007 | Reuben |
| 20080219883 A1 | 11 Sep. 2008 | Thur |
| 20090322190 A1 | 31 Dec. 2009 | Kitagawa |
| US20120138491 | 7 Jun. 2012 | Goss |
| JP H09-225012, A | 2 Sep. 1997 | KYOJI |
| JP H11-318566, A | 24 Nov. 1999 | KASAI KUNIO |
| DE 19606136 A1 | 21 Aug. 1997 | Fritz |
| CN 202801404 U | 20 Mar. 2013 | Zhang |
| EP0925794 A2 | 30 Jun. 1999 | Beghelli |
| D231593 | 7 May 1974 | Ockerman |
| D301097 | 2 Dec. 1983 | Morris |
| D319875 | 10 Sep. 1991 | Lackey |
| D327195 | 23 Jun. 1992 | Murphy |
| D327800 | 14 Jul. 1992 | Hollinger |
| D336398 | 15 Jun. 1993 | Shafer |
| D337206 | 13 Jul. 1993 | Crawford |
| D356915 | 4 Apr. 1995 | Torres |
| D370812 | 18 Jun. 1996 | Simmonds |
| D397574 | 1 Sep. 1998 | Glenton |
| D405613 | 16 Feb. 1999 | Krainsky |
| D422822 | 18 Apr. 2000 | Cayouette |
| D440090 | 10 Apr. 2001 | Lillelund |
| D443158 | 5 Jun. 2001 | Ng |
| D468945 | 21 Jan. 2003 | Dretzka |
| D478230 | 12 Aug. 2003 | Dretzka |
| D481572 | 20 May 2003 | Dretzka |
| D482222 | 18 Nov. 2003 | Dretzka |
| D502623 | 8 Mar. 2005 | Minard |
| D523674 | 27 Jun. 2006 | Starck |
| D527461 | 29 Aug. 2006 | Yue |
| D528334 | 19 Sep. 2006 | Starck |
| D530949 | 31 Oct. 2006 | Snell |
| D531811 | 14 Nov. 2006 | Cochran |
| D538437 | 13 Mar. 2007 | Yue |
| D539582 | 3 Apr. 2008 | Starck |
| D542929 | 15 May 2007 | Shin |
| D542930 | 15 May 2007 | Shin |
| D543750 | 5 Jun. 2007 | Hines |
| D545062 | 26 Jun. 2007 | Nagoya |
| D549024 | 21 Aug. 2007 | Fuentes |
| D626364 | 2 Nov. 2010 | Fretwell |
| D648539 | 15 Nov. 2011 | Wai |
| D657986 | 24 Apr. 2012 | Climer |

However, the invention and embodiments described here, below, have not been addressed or presented, in any prior art, including all the above, with all the advantages mentioned here.

SUMMARY OF THE INVENTION

In one embodiment, we describe a method and system where the brush head and the shaft that enter the user's mouth are never contacted by the chamber. Also, below the brush head and shaft, there is no chamber. If any drops of water were to fall off the brush head, they would fall all the way through the chamber and reside on the counter on which the chamber rests. While this does not eliminate the particulate, it ensures the particulate does not reside in a chamber, which may be inaccessible or hard to clean. All particulate can be removed from the counter during regular counter cleaning routines.

In one embodiment of the present invention, our sterilization means is a UV-C lamp. This selection has advantages over the other sterilizations means. Some of them are: no spilling of fluids (vs. liquid and spray sterilization), no leakage of dangerous substances into the atmosphere (vs. gas blanket sterilization), no hot surfaces (vs. autoclave sterilization), rapid (vs. drier sterilization), and quiet (vs. vacuum sterilization). One disadvantage that UV sterilization has with respect to some of the other solutions is that it utilizes light, and light is usually associated with inherent shadows. That is, if a portion of the brush head intended for sterilization is in a shadow, the efficacy of the sterilization will be greatly reduced. Some of the prior art (e.g. Pinsky U.S. Pat. No. 7,213,603) mention multiple UV lamps as a solution to get greater coverage. This, of course, directly increases manufacturing cost and would require a significant number of bulbs in order to achieve uniform coverage. Other prior art address this shortcoming by introducing reflective surfaces on the inside of the chamber. This also increases manufacturing costs. A typical method to create surfaces such as this is to sputter metal onto molded plastic surfaces. While effective, composite parts like this are difficult to recycle.

In the present invention, we show a single lamp, but that lamp is in a ring configuration (otherwise known as annular, torus, or donut), which is unique from the prior art. The brush end of the toothbrush is placed within the ring so that light approaches the brush head from a greater number of angles, and shadows are much reduced or eliminated. In practice, because of the end conditions of the lamp, the ring is interrupted. However, this interruption is minor (small distance) and most of the lamp retains the toroidal shape and the advantages thereof (with good coverage of the toothbrush, from all angles).

DETAILED DESCRIPTION OF THE PREFERRED EMBODIMENTS

The attached invention describes an electronic toothbrush sterilization system that is used by consumers. This invention introduces many new features that allow for improved cleanliness, convenience, and robustness. Toothbrush sterilization systems are known in the industry and have been available for quite some time. Originally, the toothbrushes were manual, just comprised of a handle and bristles. The sterilization source has changed over the years.

Figure 1:
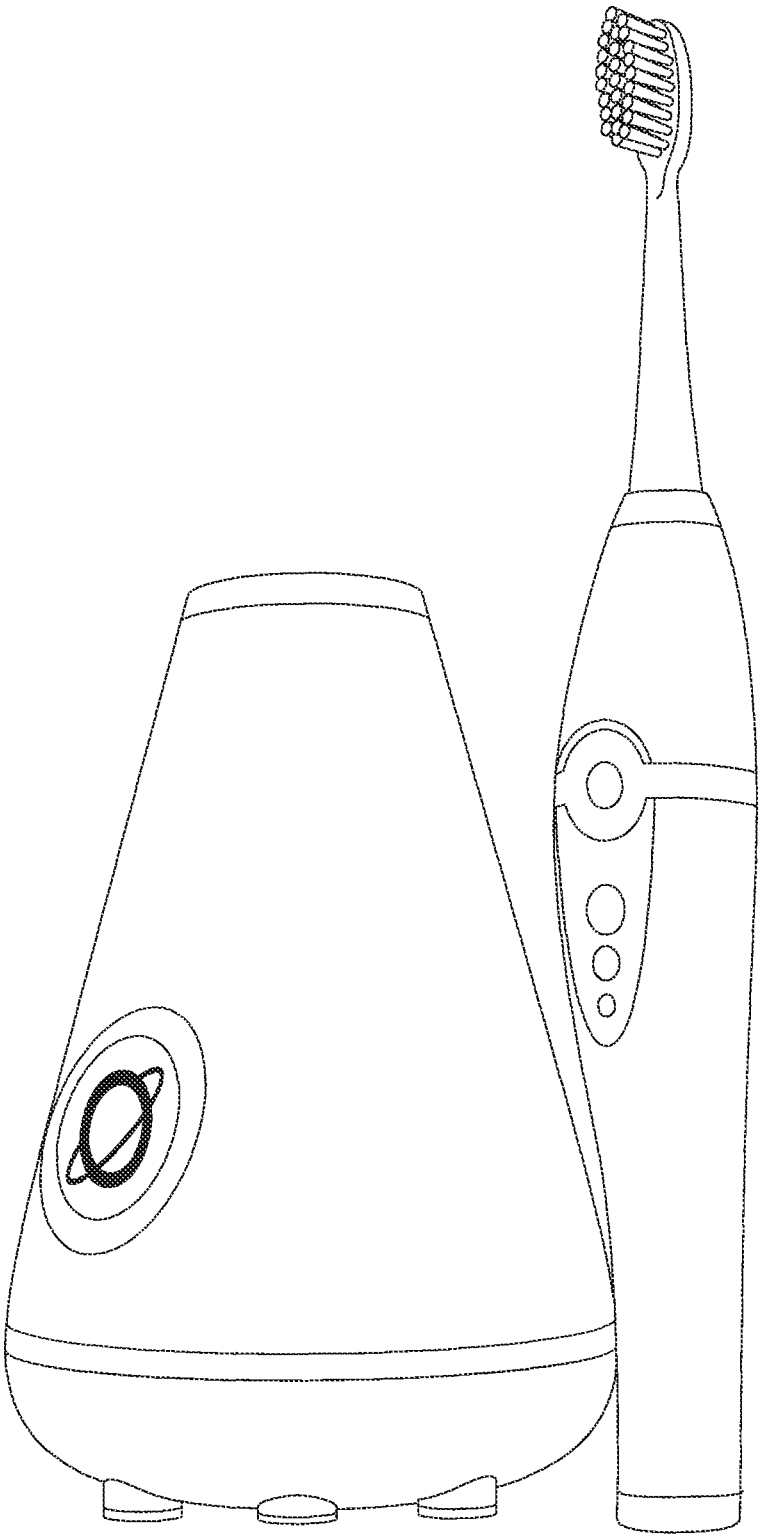
FIG. 1 is for one embodiment of our device, as an example, for a view of the chamber with a toothbrush nearby.
Figure 2:
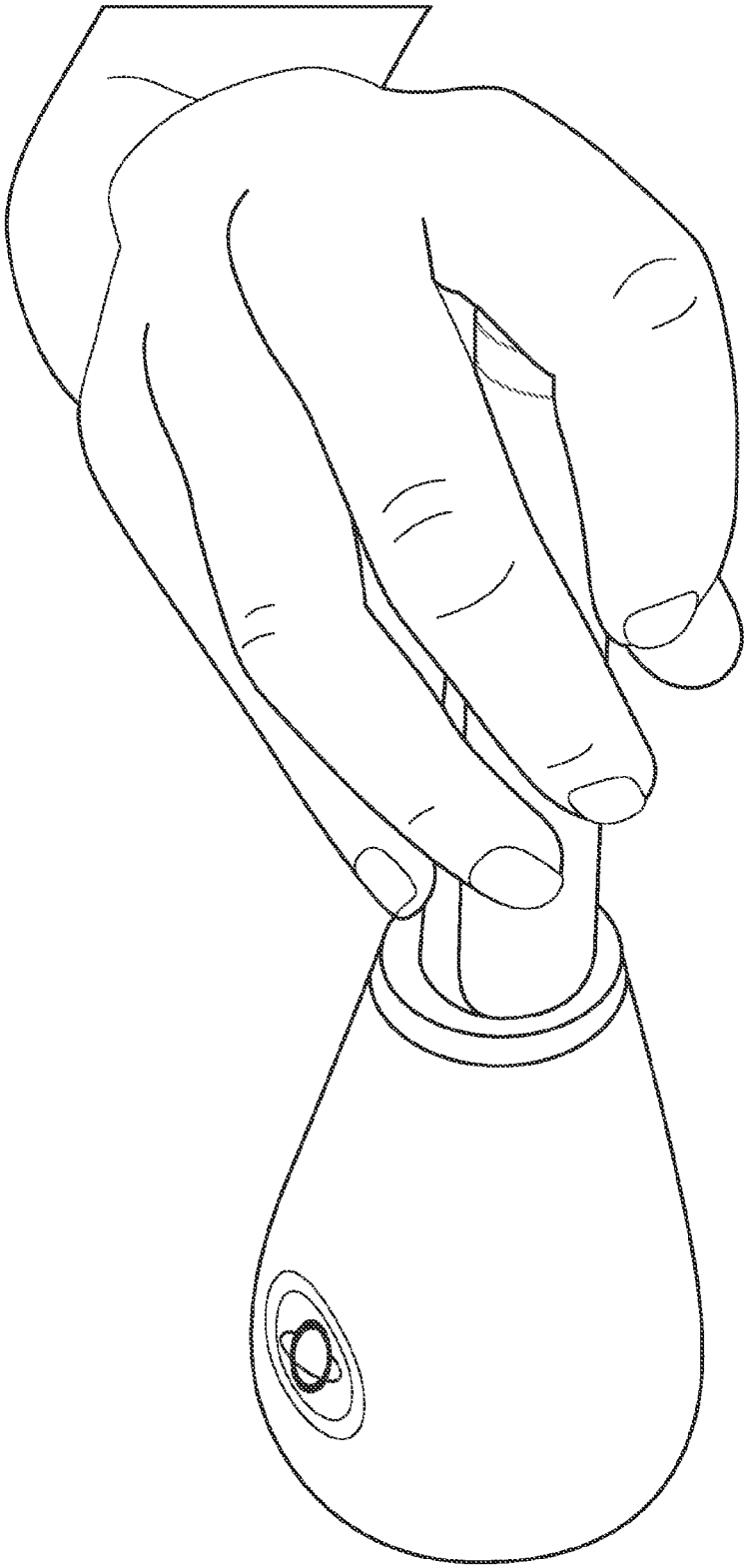
FIG. 2 is for one embodiment of our device, as an example, for a view of the chamber with a toothbrush in it.
Figure 3:
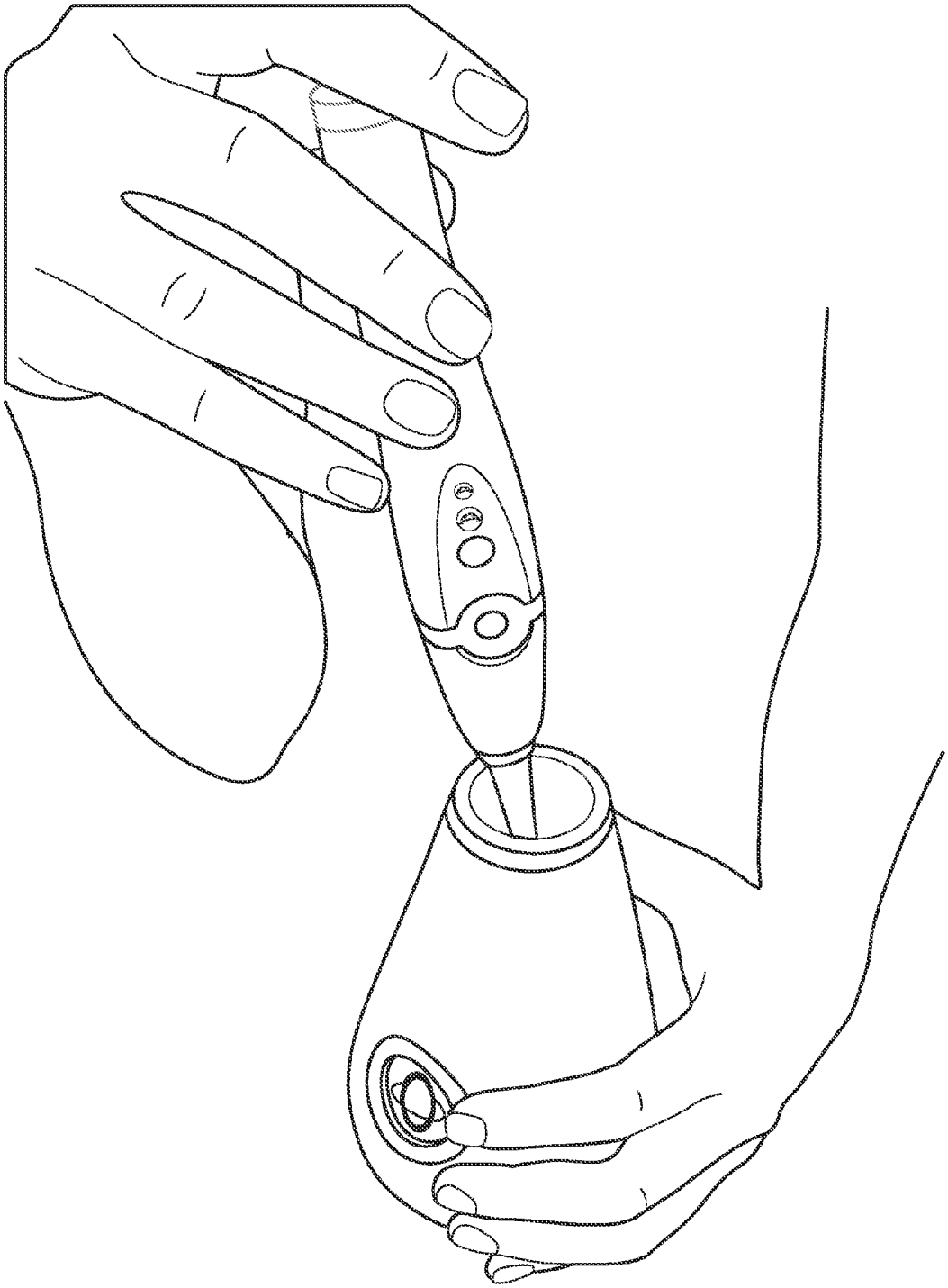
FIG. 3 is for one embodiment of our device, as an example, for a view of the chamber with a toothbrush in the process of being inserted or extracted from it.
Figure 4:
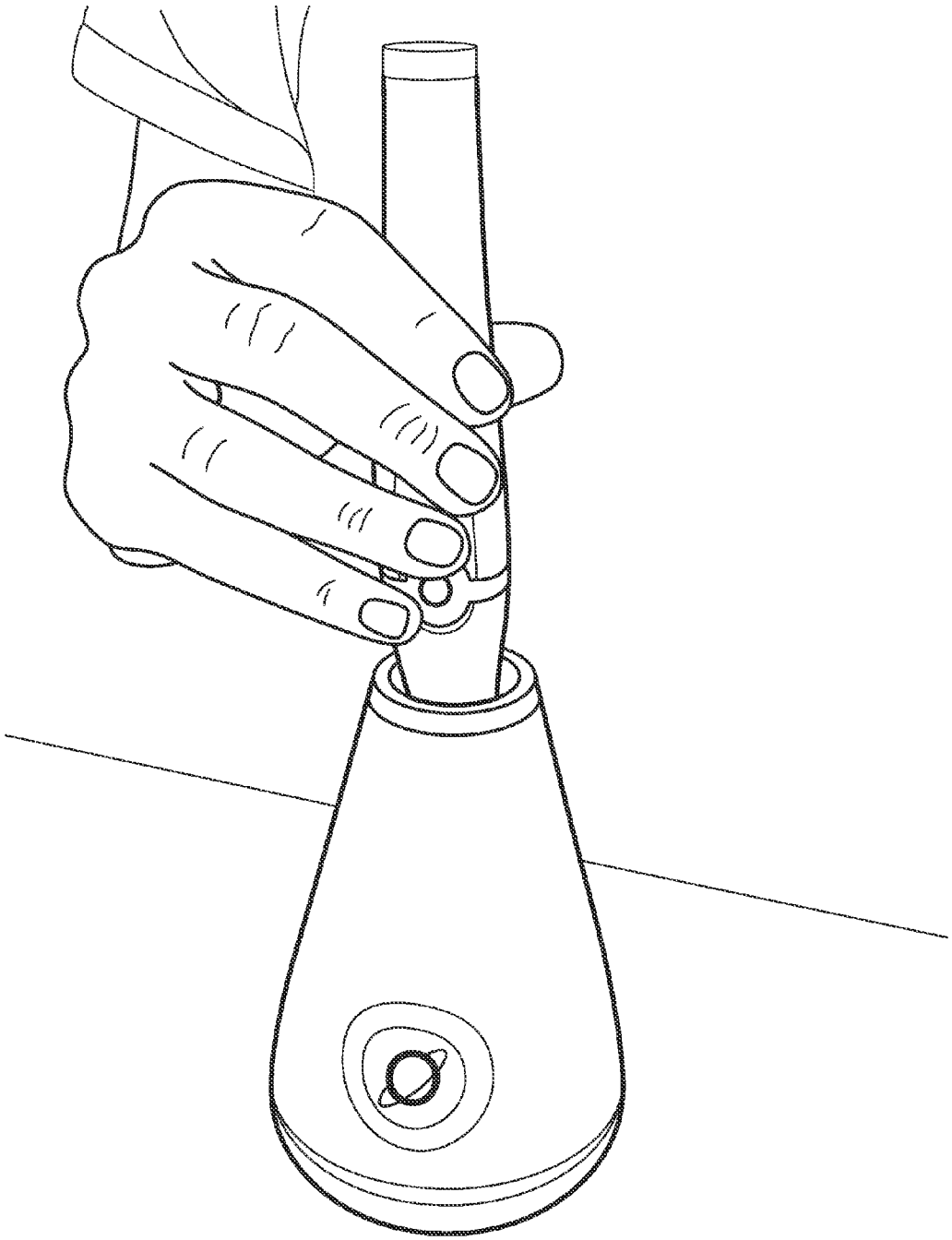
FIG. 4 is for one embodiment of our device, as an example, for a view of the chamber residing on a countertop with a toothbrush in it.

Originally, the brushes were immersed in a sterilization fluid (FIG. 1, Appendix 1) to kill germs present on the brush. Prior art of this technique was seen as early as 1904. Later (~1918), gases (e.g. formaldehyde) were used (FIG. 2, Appendix 1). There has also been evidence of heat-based sterilization methods (FIG. 18, Appendix 1) and aerosol usage (FIG. 19, Appendix 1). Later (~1940s), because of convenience and effectiveness, the sterilization source was changed to that of a light, which bathes the toothbrush in light in the UVC range (FIG. 3, Appendix 1). This light has a spectral wavelength centered roughly around 240 nm. The wavelength range of UVC light is 100-280 nm. While the light sources may emit light outside of this range (into the visible spectrum, for example), it is the light within this range that has germicidal benefits. A current product that utilizes a manual toothbrush and a UVC light is shown in FIG. 4, Appendix 1.

In the 1950s the first electronic toothbrushes were introduced. These were initially targeted toward users with reduced motor skills. Later, it became apparent that many of these devices had a greater effectiveness compared to manual brushes, when it came to cleaning teeth. The earliest brushes were plugged into an AC outlet. However, in the 1960s, battery powered versions were introduced and started being adopted widely.

Figure 5:
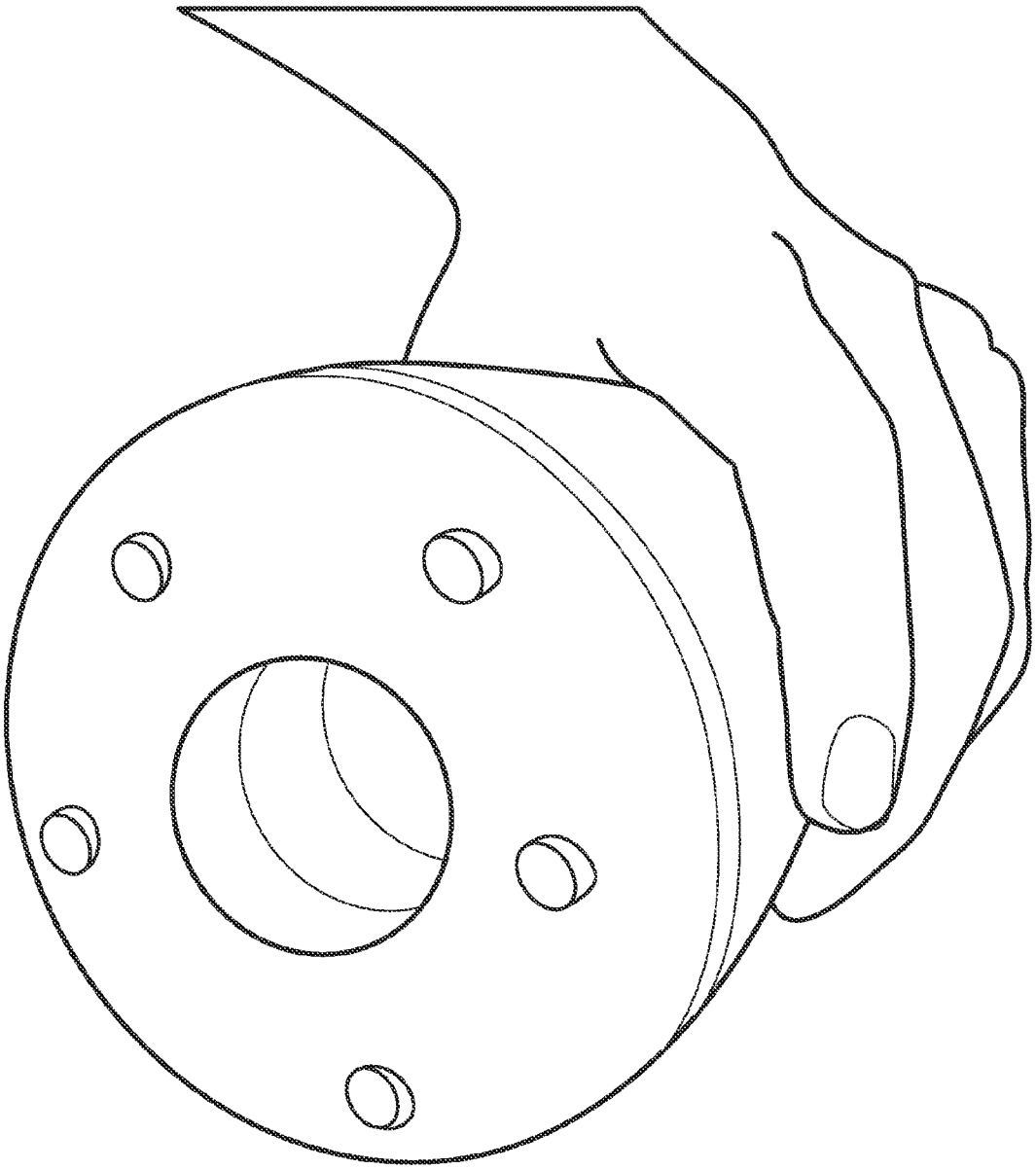
FIG. 5 is for one embodiment of our device, as an example, for a view of the bottom of the chamber.

Electronic toothbrushes can be categorized into two groups depending on the motion the bristles are driven. One group employs vibration. The majority of these vibration toothbrushes today are called ultrasonic toothbrushes, since the vibration of the bristles is above 20 kHz (which is the upper limit of human hearing) (FIG. 5, Appendix 1).

Figure 6:
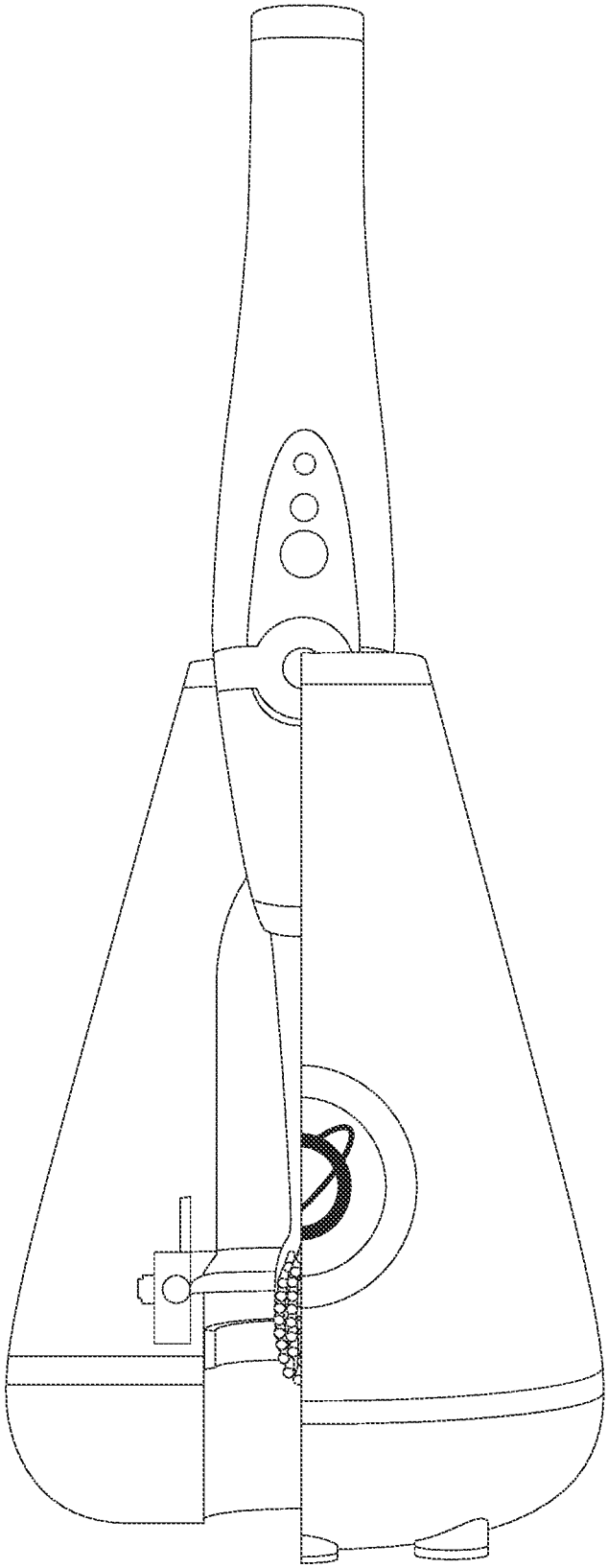
FIG. 6 is for one embodiment of our device, as an example, for a view of the chamber with a toothbrush in it, as a partial cross section.

The second major category of electronic toothbrushes is rotational. With these, the bristles rotate continuously or oscillate in a rotating manner about an axis (FIG. 6, Appendix 1).

Figure 7:
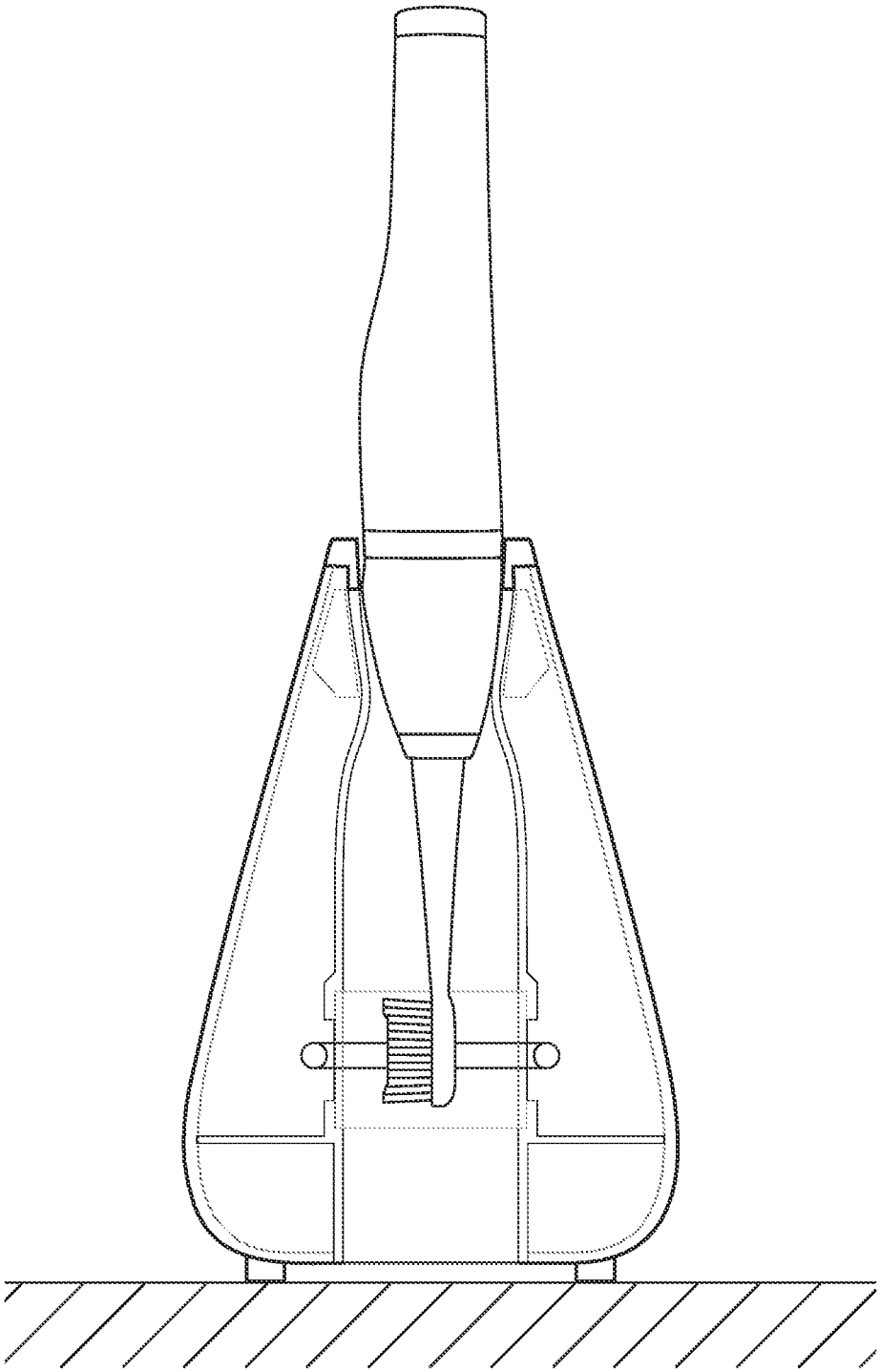
FIG. 7 is for one embodiment of our device, as an example, for a view of the cross section of the chamber with a toothbrush in it.
Figure 8:
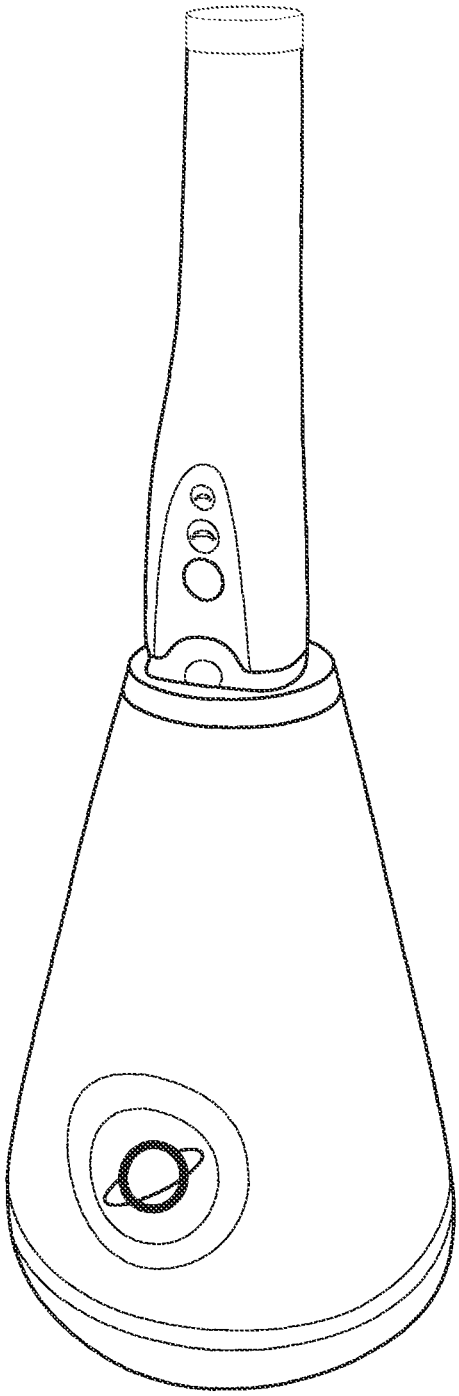
FIG. 8 is for one embodiment of our device, as an example, for a view of the chamber with a toothbrush in it.

Products that sterilize electronic toothbrushes have been known for some time as well (FIG. 7 and FIG. 8, Appendix 1). In these systems, there is a charging circuit that keeps the batteries in the toothbrush handle fully charged. In addition, there is a UVC light source that shines on the bristles. In all the currently shipping products that we are aware of, the brush head is detached from the handle for the sterilization process. The bristles, along with a short section of shaft (which is defined collectively in this document as the brush head), are placed into a separate chamber that contains the UVC light source, and the light is activated.

The disadvantages of the current state-of-the-art electronic toothbrush sterilization systems are described below:

(1) When the user has finished brushing his/her teeth, the handle is returned to the charging station. This is very convenient as the station reserves some countertop real estate for the product, and the user knows precisely where the product is when they need to use it again. However, to actually sterilize the bristles, extra effort is needed to separate the brush head from the handle and place it in the sterilization chamber. While this is not a lot of extra work, it turns out that many users choose not to sterilize the brush head after each brushing. This creates the opportunity for pathogens (e.g. virus, bacteria, parasite, or fungus) to grow on the wet head of the brush, which is a terrible result.

(2) When the brush head is removed from the handle and placed in the sterilization container, the toothbrush is not immediately ready for use. The handle is present, but there is no brush head attached to it. The brush head needs to be removed from the sterilization container and reattached to the handle.

(3) When the brush head remains attached to the handle after use and is not placed in the sterilization chamber, it is exposed to the environment. This environment is typically a bathroom environment that has many sources of water flow (e.g. sinks, showers, toilets and bathtubs). These water sources aerosolize water droplets. These water droplets can transport other elements such as urine, feces, and saliva throughout the bathroom. Since the bristles are exposed to this environment, they can become inadvertently contaminated.

(4) In the existing devices, the sterilization chamber has a closed bottom with one opening where the brush head is inserted and removed. In addition, this chamber often has many acute internal angles within and between various parts (i.e., nooks and crannies). Bristles that are placed in this environment are wet (having just been used). This water can and does drip off the bristles and stays behind in the chamber. These pools of water, if not in direct line of sight to the UVC light source can fester and grow a community of pathogens.

Figure 9:
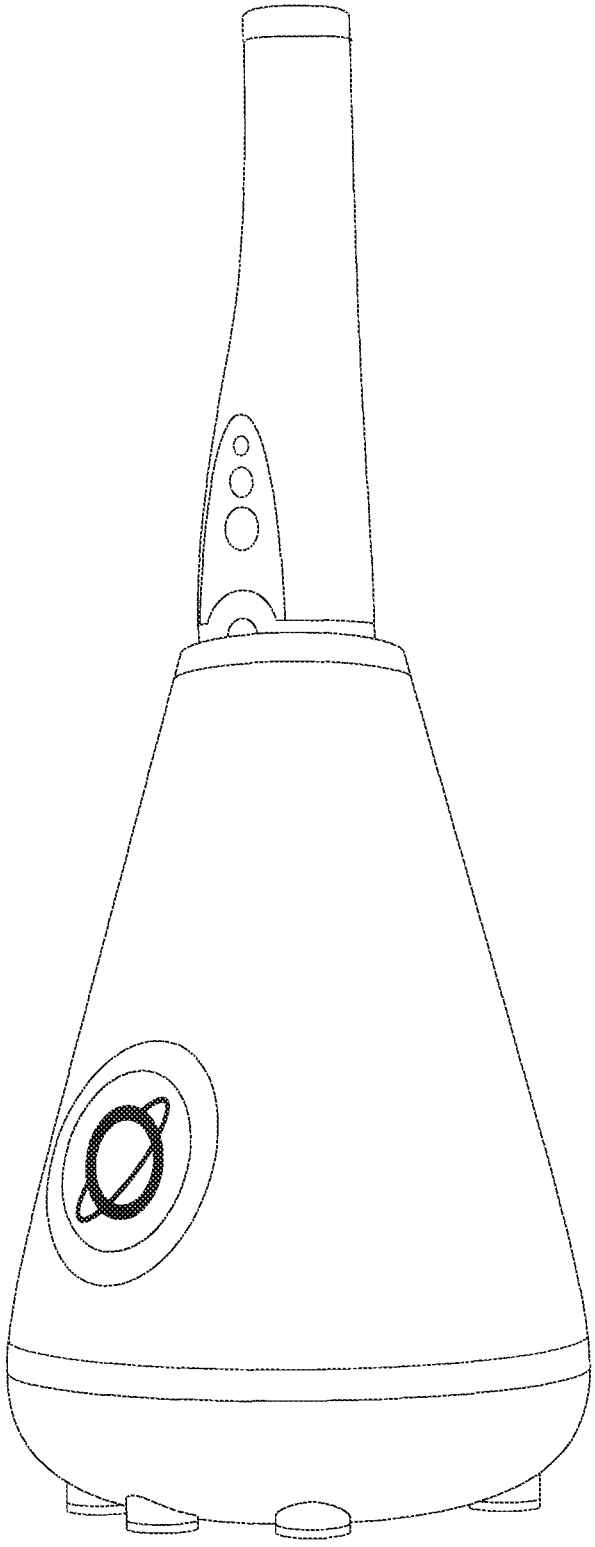
FIG. 9 is for one embodiment of our device, as an example, for a view of the chamber with a toothbrush in it.

(5) The light source in the existing sterilization chamber is either a point light source or a line light source (FIG. 9, Appendix 1). This invariably creates shadows in the bristle area, where the light is not as effective as it is not bathing the entirety of the bristles.

(6) The existing systems go though the same cleaning cycle regardless of the number of times the brush has been used between cleanings (7) The sterilization chamber is very difficult to clean.

(8) The light source in the existing systems is very accessible to the user. In fact, the user can inadvertently touch the light source with his/her hand or with the brush head. This could add contaminants (e.g., oil or particulate matter) to the surface of the light, thereby reducing its emission and efficacy.

Figure 10:
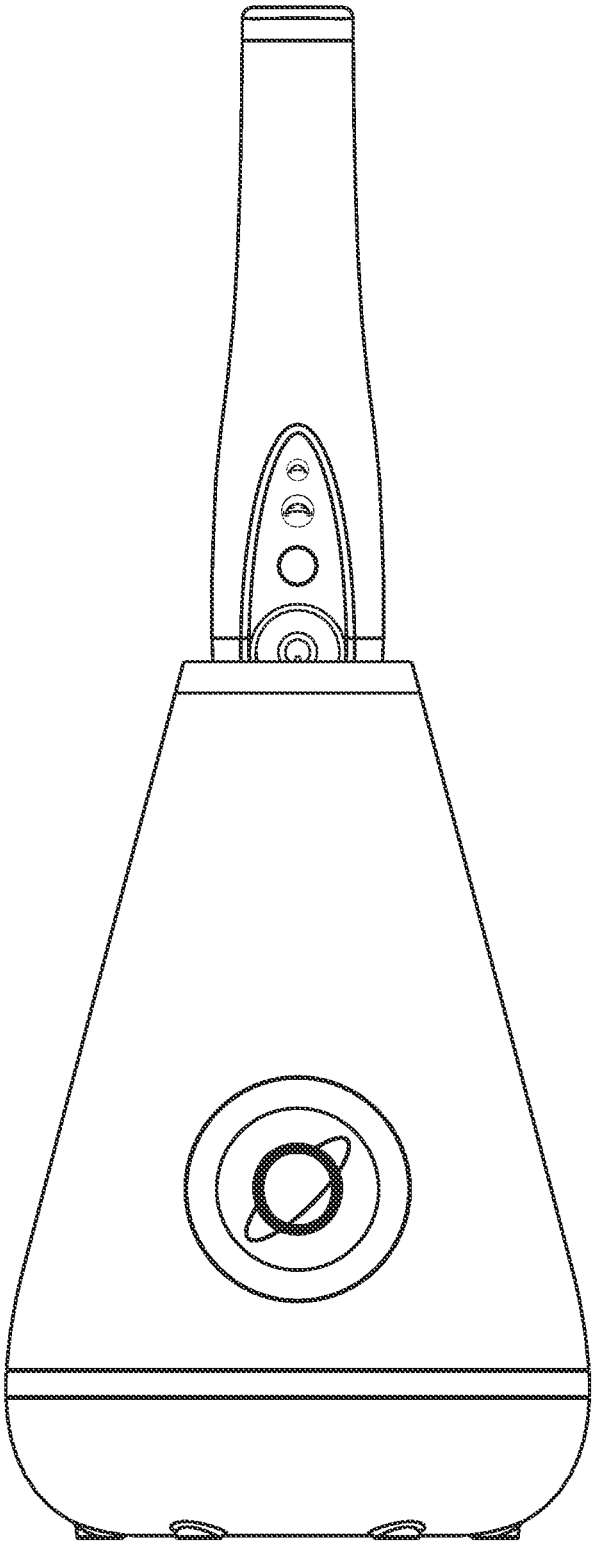
FIG. 10 is for one embodiment of our device, as an example, for a view of the chamber with a toothbrush in it.
Figure 11:
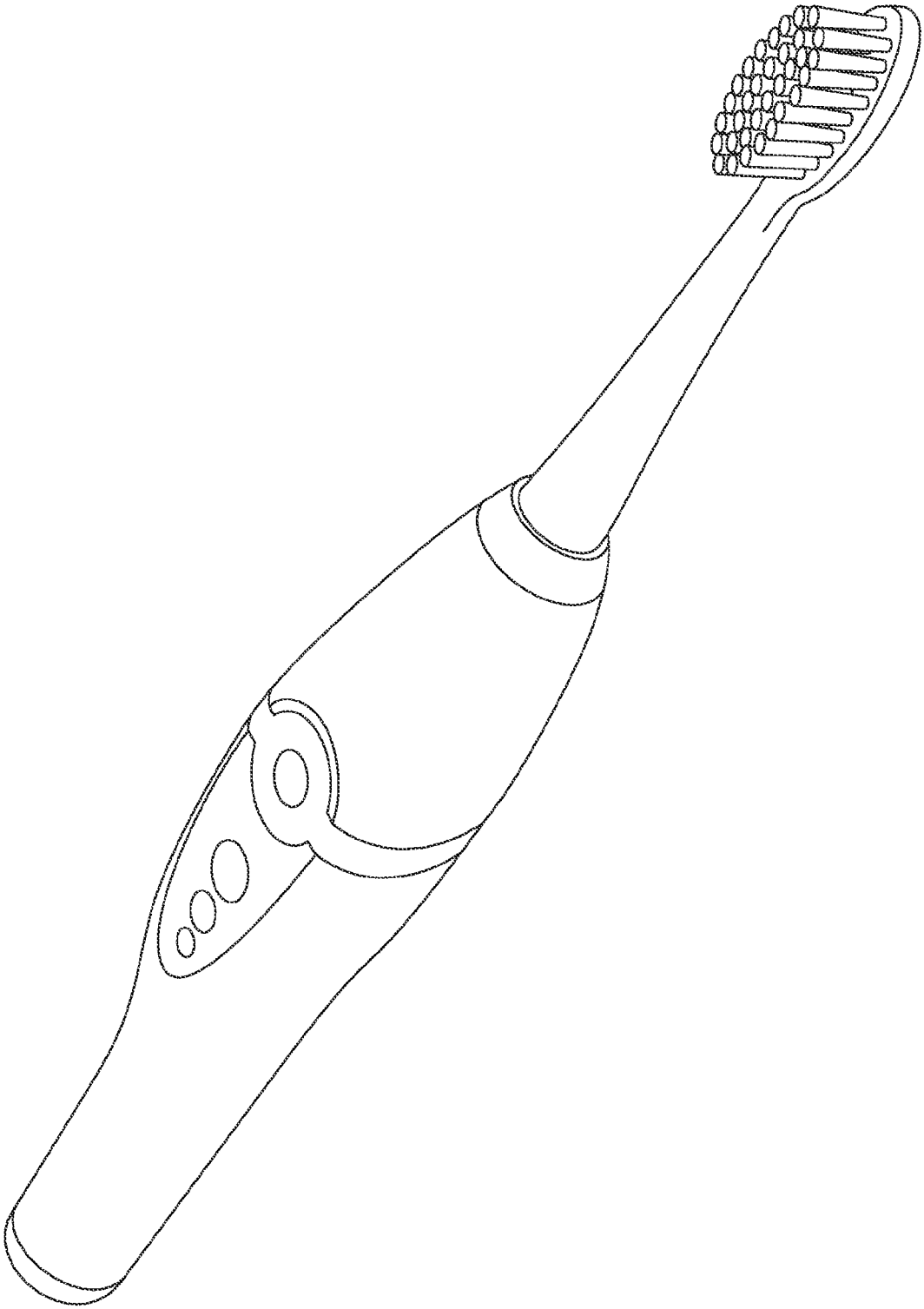
FIG. 11 is for one embodiment of our device, as an example, for a view of the toothbrush.

One embodiment of the current invention incorporates an integrated charging station and sterilization chamber (FIG. 10, Appendix 1). This base station is either corded to AC power or runs on its own internal batteries. The electronic toothbrush (FIG. 27, Appendix 1) is inserted into the base station with the brush head end down (FIG. 11, Appendix 1). Once it is inserted, the brush head is removed from the environment, which keeps it cleaner and more sterile than being left in the environment between brushings. This helps to solve the issue raised in the current art, mentioned in Section (3) above.

The toothbrush (FIG. 12, Appendix 1) has an internal charging coil near the brush head end. This creates a non-contact inductive coupling between this coil and a similar coil in the base (FIG. 13, Appendix 1). Once the base detects the presence of the toothbrush, the charging commences and the sterilization cycle begins. The sterilization is accomplished by means of a UVC light source within the charging station (FIG. 13, Appendix 1). This UVC light source could be a point or a line source similar to the current state of the art. In one embodiment, it is a light source that wraps around the brush head eliminating shadows mentioned in Section (5) above (FIG. 14, Appendix 1).

This ring light could be a mercury vapor tube light (FIG. 15, Appendix 1). It could also be a series of point light sources that wrap around the brush head. Alternatively, there could be a single light source that is brought up to and surrounds the brush head via a light pipe. To further aide in the elimination of shadows, the interior of the sterilization chamber could be made reflective. (FIG. 14, Appendix 1). Aluminum coatings have been shown to reflect UVC light very effectively. During the sterilization cycle, the UVC light turns on for a pre-determined amount of time. The amount of time could vary based on the number of brush cycles that the toothbrush has been through since the last cleaning. This addresses problem in Section (6) above.

The brush handle can keep track of usage and this information can be communicated to the base station via means such as RFID tracking or Bluetooth communication. Once the brush is inserted in the base, the sterilization cycle commences. Since this takes no additional effort to accomplish from the user, it addresses the shortcomings of the current products referenced in Sections (1) and (2) above.

The chamber of the preferred design is devoid of crevices that could become water traps. If water drips off the brush head, the water falls through the device through an opening in the bottom of the chamber (FIG. 13, Appendix 1). This addresses the current problem stated in Section (4) above. This water could reside on the countertop until it evaporates away.

Alternatively, there could be a hydrophilic pad that resides below the chamber (FIG. 16, Appendix 1). This pad could wick the water throughout its volume or along its surface. Because the water is spread out, it has more evaporative surface area and is lost to the environment at a significantly accelerated rate. This pad could have other functions in that it could cradle and prevent the unit from tipping over. Because the chamber is open on both ends and is lacking in crevices, it is easy to clean with a device such as a baby bottle cleaner, an attachment to the toothbrush or even a towel (FIG. 17, Appendix 1) addressing the concern of Section (7) above.

Since there can be a communication link between the brush and the base station, either of those could have a display to communicate information to the user (FIG. 16, Appendix 1). This display can show things like charging time remaining, sterilization time remaining, number of brushing cycles completed, life of brush head remaining, and average brushing duration, among others (FIGS. 20-23, Appendix 1).

When the brush is being inserted into the base station, the design is such that the bristles are prevented from touching the light source (FIG. 30, Appendix 1). The light source is also buried deep within the chamber, which minimizes the possibly of the user touching it directly. This goes to addressing problem of Section (8) mentioned above.

Other elements and further clarification of the invention are shown in FIGS. 24-26, 28-29, and 31-33, Appendix 1. All the foregoing could be applied to a manual as well as electrical toothbrush.

Figure 12:
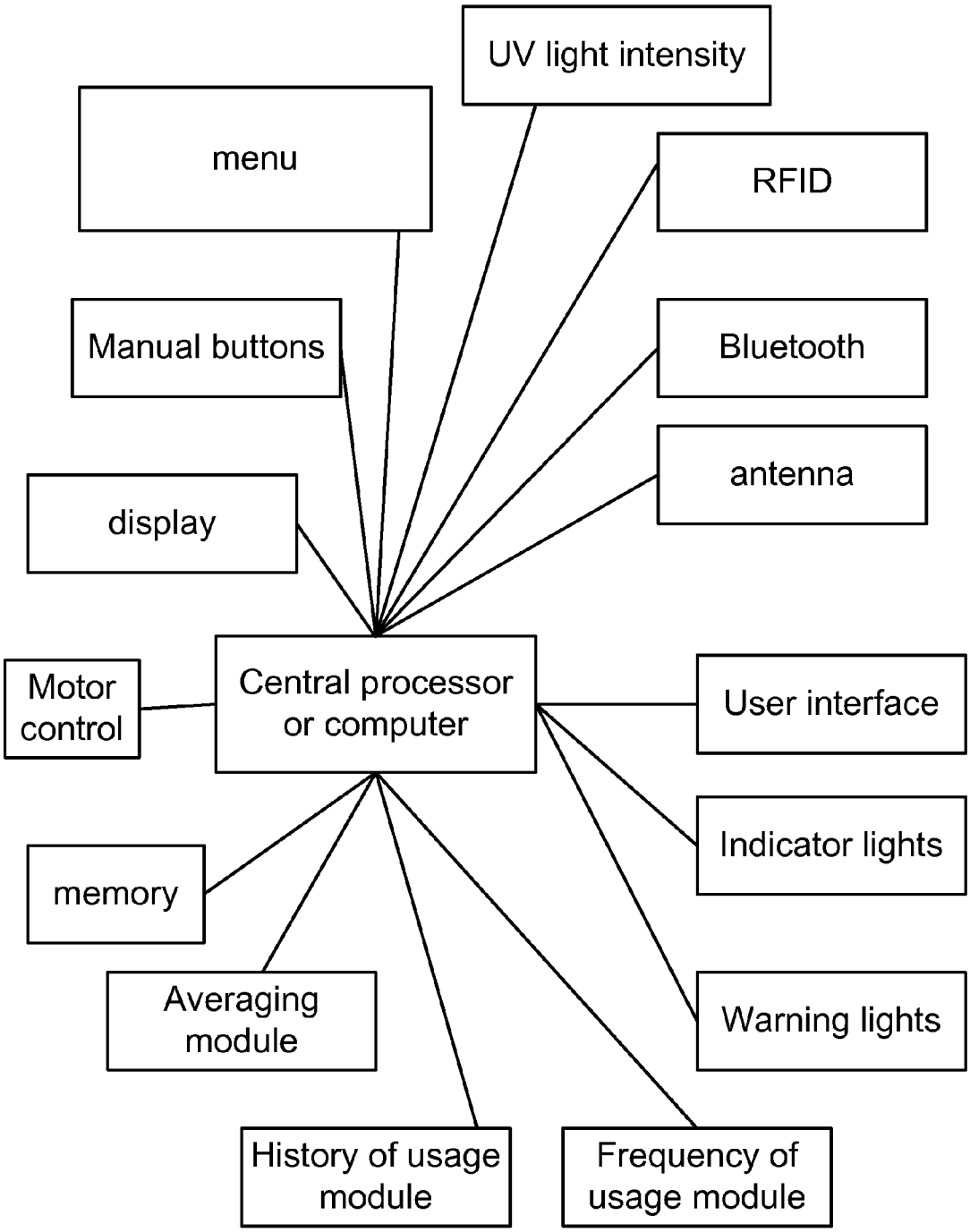
FIG. 12 is for one embodiment of our system, as an example, for a view of the components of our system.

Appendix 1 (in 2 separate files) includes the following "Appendix 1—Figures": FIG. 10 shows the chamber from different views. FIG. 11 shows brush to chamber docking, the placement, and the gap. FIG. 12 shows RFID chip and the cross section of the brush. FIG. 13 shows the UV light source and inside the chamber. FIG. 14 shows inside the chamber with the reflective surface, like mirror, for maximum effect. FIG. 15 shows the UV bulb, with curvature, circle shaped. FIG. 16 shows the chamber pad, its shape, and its usage, as well as indicator light and/or display options on the chamber's outside surface, for warning or information for the user, e.g., for charged left on the device, and amount of brushing time or frequency, e.g., with multiple lights or diodes, or bar shaped light or indicator, or sliding scale indicator, or colored lights, or light of varying intensity proportional to the value of the indicated parameter, e.g., light intensity proportional to the charge left on the battery, or using red light as warning for low charge indication. FIG. 17 shows chamber cleaning brush. FIG. 20 shows brush to chamber activation. FIG. 22 shows cleaning cycle sequence, for self-cleaning FIG. 23 shows charging cycle sequence. FIG. 24 shows the description and advantages of our chamber/toothbrush system and their designs/parameters/components. FIG. 25 shows cleaning procedure (Function 1). FIG. 26 shows charging procedure (Function 2). FIG. 27 shows advanced sonic brush, with components, from different angles. FIG. 28 shows the inside chamber with details. FIG. 29 shows the inside chamber with UV light source ring. FIG. 30 shows the brush placement, in motion. FIG. 31 shows the light pipe inside chamber. FIG. 32 shows the retractable cable or wire for our system, for compact and clean setup, with optional spring to retract the wire, e.g., located at the inside bottom of the chamber, with optional hook to release the spring for retraction process. FIG. 33 shows drying procedure/sequence (Function 3), with gaps for drying process, with thermal energy or radiant energy, as options, with convection, conduction, or radiation mechanism, with increased airflow, with some air coming from the gaps around the chamber's legs or feet. The units or devices for thermal energy or radiant energy can be inserted into the middle of the chamber cavity, as moveable parts, or they can be stationary, on the walls or in the middle of the chamber.

Appendix 2, pages 1-11, show different views of the chamber and toothbrush with more details and cross-sectional views.

In one embodiment, we have multiple chambers on the unit for (to hold) multiple toothbrushes, e.g., with common power supply or battery backup for the toothbrushes and UV light sources. In one embodiment, we have multiple rings for the UV light sources in the same chamber. In one embodiment, the multiple rings for the UV light sources are in parallel to each other. In one embodiment, we have multiple rings for the UV light sources parallel to the ground or countertop. In one embodiment, we have multiple rings for the UV light sources at an angle to the horizontal ground or countertop, e.g., at 15, 30, 40, 45, 55, 60, or 80 degrees, with respect to the horizontal ground.

In one embodiment, we have some fins or tracks or grooves on the inside body of chamber and/or on the toothbrush handle (or both) to cause some gaps between the toothbrush and inside chamber for air to flow, for better drying process and better drainage of the water, when the toothbrush is set in the chamber after each use (See, e.g., FIG. 11, Appendix 1).

In one embodiment, we have batteries and charging coil inside the toothbrush body, with RFID chip mounted on or inside the system, for communication with a computer, smart phone, and chamber, e.g., for transmission of the data, authentication, and identification, e.g., for display of the time of usage, remaining charge of the device, and the like, for both versions of RFID (active & passive). (See, e.g., FIG. 12, Appendix 1) In one embodiment, we have Bluetooth devices for short range communications, one being installed on toothbrush and/or chamber.

In one embodiment, the source of the UV is inside the chamber. In one embodiment, the source of the UV is outside the chamber, e.g., coming from the fiber optics or waveguides to the chamber. In one embodiment, the light gets split to multiple rays by a splitter on its way, for a better coverage of the object to be cleaned. (See, e.g., FIG. 31, Appendix 1) In one embodiment, there is a mirror or sets of mirror or reflection surface or curved reflective surface inside the chamber, focusing the light or directing the light on the toothbrush for cleaning, e.g. spherical or cylindrical or conical shape, as concave mirror or surface, e.g., using metal coating. (See, e.g., FIG. 13, Appendix 1)

In one embodiment, the focus area is on focal point of the mirror. In one embodiment, the source can be a ring or thick ring or multiple rings or parallel rings or horizontal rings or array of rings or rings with various wavelengths in UV range (or diodes or lasers or other light sources). (See, e.g., FIG. 14, Appendix 1)

In one embodiment, the chamber cleaning brush, with multiple brush heads, exchangeable on the device or on the toothbrush body or on a separate rod or stick, is used to clean the chamber by the user. (See, e.g., FIG. 17, Appendix 1) It can have multiple brushes on the same stick or bar or rod, with different shapes, for better cleaning.

In one embodiment, the chamber light, menu, or display can give choices to the user for functionalities, e.g., inputting data by user, or give information or warning to user, e.g., using color lights or diodes, to indicate the charging stages for the toothbrush, or malfunction of a component, using a warning red light. (See, e.g., FIG. 20, Appendix 1)

FIG. 21, Appendix 1 shows cleaning cycle sequence. Note that the selective cleaning intensity is based on the frequency of the brush insertion, e.g.: The higher the frequency, the higher the intensity. This intensity (I) can be linear proportional (with k as coefficient) or non-linear proportional to the frequency value (f), for different embodiments. For example, one case may be: ($I=k*f$), where I is the intensity of the light, and f is the frequency or number of brushing or length of time of brushing per unit time, e.g., per week or month or day (or average value, or running-average, or cumulative average), wherein * denotes the multiplication operation. The intensity can be based on: Radiant intensity, measured in watts per steradian (W/sr), or Luminous intensity, measured in lumens per steradian (1 m/sr), or candela (cd), or Irradiance or Intensity, measured in Watts per meter squared (W/m2), or Radiance, measured in ($W \cdot sr-1 \cdot m-2$).

In one embodiment, the charging is done by direct metal contact and wiring, with backup battery or rechargeable battery. In one embodiment, the charging is done by inductive coil, remotely, with no direct or metal contact. The material of the chamber can be any synthetic or natural material, as in the prior art, e.g., plastic. In one embodiment, the brush and contour of the inside chamber are designed such that they do not touch or cross-contaminate. (See, e.g., FIG. 30, Appendix 1)

FIGS. 1-11 correspond to pages 1-11 (FIGS. 1-11) of Appendix 2. FIG. 5 is for one embodiment of our device, as an example, for a view of the chamber. FIGS. 1-4, 8-10 are for embodiments of our device, as examples, for views of the chamber with a toothbrush. FIG. 6 (or FIG. 7) is for one embodiment of our device, as an example, for a view of the chamber with a toothbrush in it, as a cross section. FIG. 11 is for one embodiment of our device, as an example, for a view of the toothbrush.

FIG. 12 is for one embodiment of our system, as an example, for a view of the components of our system, comprising: menu, manual buttons, and display; RFID, Bluetooth, and antenna; user-interface, indicator lights, and warning lights; frequency of usage, history of usage, averaging module (to average values for comparisons, for baseline values, or for history or performance values, so far), and memory; motor control; UV lamp; brush dryer; mode lights; charging circuit; and external power supply.

Other Embodiments are, with their Variations and Examples

A dental hygiene system, comprising of:

An oral care implement with a handle at one end, a mouth care end effect at the distal end, and a shaft between the two.

The mouth care end effect and said shaft enter the user's mouth during normal usage.

A free-standing chamber for storing said oral care implement.

Said chamber contains a sterilization means.

While stored or during sterilization, if debris were to fall from said mouth care end effect or said shaft, said debris would not contact any part of said chamber.

Said mouth care end effect resides below said handle, while stored.

A heater to drive moisture from the said end effect.

The oral care implement is electronic and battery powered.

Said chamber includes a charging circuit to charge the batteries of said oral care implement.

A dental hygiene system, comprising of:

An oral care implement with a handle at one end, a mouth care end effect at the distal end, and a shaft between the two.

Said mouth care end effect and said shaft enter the user's mouth during normal usage.

A free-standing chamber for storing said oral care implement, where said mouth care end effect and said shaft reside inside the chamber, while at least a portion of said handle resides outside.

Said chamber contains a sterilization means.

Said chamber does not contact said mouth care end effect, nor said shaft, when inserting, removing, or storing within said chamber.

Said oral care implement can be inserted or removed from said chamber without additional actions taken upon said chamber or said oral care implement.

Said chamber is open to the environment (gravitationally) below said mouth care end effect and said shaft, during sterilization and storage.

Said mouth care end effect resides below said handle, while stored.

A heater to drive moisture from the said end effect.

The oral care implement is electronic and battery powered.

Said chamber includes a charging circuit to charge the batteries of said oral care implement.

A dental hygiene system, comprising of:

An oral care implement.

A free-standing chamber for storing said oral care implement.

Said chamber contains a sterilization means.

Said sterilization means is comprised of at least one lamp that emits light in the ultraviolet spectrum.

At least one of said lamps is a singular light source, where the majority of its geometry can be described as a torus.

Any variations of the above teaching are also intended to be covered by this patent application.

The invention claimed is:

1. An oral care system, said system comprising:

a chamber with a chamber wall;

wherein said chamber has a cavity, stretching from top to bottom of said chamber and inclusive of top and bottom of said chamber, creating an upper opening and a lower opening, said chamber having an open-ended top and an open-ended bottom;

wherein a brush head of a toothbrush is placed in said cavity, through said open-ended top;

wherein of said chamber, only part of said cavity is located directly below said brush head, when said brush head is placed in said cavity;

a light source that emits ultraviolet light;

wherein said ultraviolet light is present in at least a portion of said cavity.

2. The oral care system as recited in claim 1, wherein a brush of said toothbrush is located below a handle of said toothbrush.

3. The oral care system as recited in claim 1, said system comprises:

a drying device.

4. The oral care system as recited in claim 1, said system comprises:

a radiant energy source inside said chamber.

5. The oral care system as recited in claim 1, said system comprises:

a heating source inside said chamber.

6. The oral care system as recited in claim 1, said system comprises:

a convection source inside said chamber.

7. The oral care system as recited in claim 1, said system comprises:

protrusions;

wherein said protrusions is located between said chamber and a surface that supports said oral care system, for passage of air, from under said chamber, to said cavity.

8. The oral care system as recited in claim 1, wherein said toothbrush is an electric toothbrush.

9. The oral care system as recited in claim 1, wherein said toothbrush is battery-operated.

10. The oral care system as recited in claim 1, wherein there is a gap between a brush of said toothbrush and said chamber wall.

11. The oral care system as recited in claim 1, wherein there is a gap between said toothbrush and said chamber wall, for air flow.

12. The oral care system as recited in claim 1, said system comprises:

a charging circuit between said chamber and said toothbrush.

13. An oral care system, said system comprising:

a chamber;

wherein said chamber has a cavity, stretching from top to bottom of said chamber and inclusive of top and bottom of said chamber, creating an upper opening and a lower opening, said chamber having an open-ended top and an open-ended bottom;

wherein a brush head of a toothbrush is placed in said cavity, through said open-ended top;

wherein of said chamber, only part of said cavity is located directly below said brush head, when said brush head is placed in said cavity;

a light source that emits ultraviolet light;

wherein said light source is located inside said chamber;

wherein said light source is substantially toroidal or circular in shape;

wherein said light source wraps around a brush of said toothbrush.

14. The oral care system as recited in claim 13, wherein said ultraviolet light source is a mercury-vapor lamp.

15. An oral care system, said system comprising:

a chamber with a chamber wall;

wherein said chamber has a cavity, stretching from top to bottom of said chamber and inclusive of top and bottom of said chamber, creating an upper opening and a lower opening, said chamber having an open-ended top and an open-ended bottom;

wherein said upper opening is an open docking port leading from outside of said chamber to said cavity;

a toothbrush comprised of a brush end and a handle end;

wherein said handle end docks with said chamber;

wherein when docked, said brush end resides in said cavity through said open-ended top and said handle end resides outside said chamber;

wherein of said chamber, only part of said cavity is located directly below said brush end, when said brush end is placed in said cavity;

wherein during docking, there is a gap between said brush end and said chamber wall;

an ultraviolet light source;

wherein said ultraviolet light source illuminates automatically, upon said docking.

16. The oral care system as recited in claim 15, wherein said brush end of said toothbrush is located below said handle end of said toothbrush.

17. The oral care system as recited in claim 15, said system comprises:

a drying device.

18. The oral care system as recited in claim 15, said system comprises:

a radiant energy source inside said chamber.

19. The oral care system as recited in claim 15, said system comprises:

a heating source inside said chamber.

20. The oral care system as recited in claim 15, said system comprises:

a convection source inside said chamber.

21. The oral care system as recited in claim 15, said system comprises:

chamber feet located under said chamber.

22. The oral care system as recited in claim 15, wherein said toothbrush is an electric toothbrush.

23. The oral care system as recited in claim 15, wherein said toothbrush is battery-operated.

24. The oral care system as recited in claim 15, said system comprises:

a charging circuit between said chamber and said toothbrush.

* * * * *